US005559725A

United States Patent [19]

Nielson et al.

[11] Patent Number: 5,559,725

[45] Date of Patent: Sep. 24, 1996

[54] AUTOMATIC DEPTH CONTROL FOR TRENCHER

[75] Inventors: Edward G. Nielson; Timothy S. DeBruine, both of Grands Rapids; Daniel P. Modzeleski, Belmont; Ross C. Stoepker, Kentwood, all of Mich.

[73] Assignee: Laser Alignment, Inc., Grand Rapids, Mich.

[21] Appl. No.: 319,961

[22] Filed: Oct. 7, 1994

[51] Int. Cl.[6] ..... G05D 1/04; E02F 5/02

[52] U.S. Cl. ..... 364/550; 37/348; 37/415; 364/424.07

[58] Field of Search ..... 364/550, 424.07, 364/424.01, 559, 561, 562, 420, 422; 37/348, 414, 415, 347

[56] References Cited

U.S. PATENT DOCUMENTS

| | | | |
|---|---|---|---|
| 1,300,371 | 4/1919 | French . | |
| 2,778,130 | 1/1957 | Gurries et al. . | |
| 2,919,490 | 1/1960 | Bethany . | |
| 2,919,505 | 1/1960 | Bethany . | |
| 3,058,242 | 10/1962 | Ocnaschek . | |
| 3,564,531 | 2/1971 | Burgin . | |
| 3,659,364 | 5/1972 | Wilson . | |
| 3,708,232 | 1/1973 | Walsh . | |
| 3,727,332 | 4/1973 | Zimmer . | |
| 3,803,574 | 4/1974 | Logue | 37/348 X |
| 3,900,073 | 8/1975 | Crum . | |
| 3,997,071 | 12/1976 | Teach . | |
| 4,034,490 | 7/1977 | Teach . | |
| 4,044,610 | 8/1977 | Oldaeus et al. . | |
| 4,050,171 | 9/1977 | Teach . | |
| 4,129,224 | 12/1978 | Teach . | |
| 4,157,118 | 6/1979 | Suganami et al. . | |
| 4,244,123 | 1/1981 | Lazure et al. | 37/348 |
| 4,255,883 | 3/1981 | Ealy . | |
| 4,282,933 | 8/1981 | Suganami et al. . | |
| 4,288,196 | 9/1981 | Sutton II . | |
| 4,332,517 | 6/1982 | Igarshi et al. . | |
| 4,452,078 | 6/1984 | Formanek et al. . | |
| 4,491,927 | 1/1985 | Bachmann et al. . | |
| 4,542,600 | 9/1985 | Hoehn Jr. . | |
| 4,561,188 | 12/1985 | Williams et al. . | |
| 4,677,555 | 6/1987 | Goyet | 37/348 X |
| 4,820,041 | 4/1989 | Davidson et al. | 364/424.07 X |
| 4,888,890 | 12/1989 | Studebaker et al. . | |
| 4,923,015 | 5/1990 | Barsby et al. . | |
| 5,174,385 | 12/1992 | Shinbo et al. | 364/424.07 X |
| 5,375,663 | 12/1994 | Teach . | |

FOREIGN PATENT DOCUMENTS

| | | |
|---|---|---|
| 0223189A | 6/1985 | Germany . |
| 3627015A | 2/1988 | Germany . |
| 0192078A | 1/1967 | U.S.S.R. . |
| 0520432A | 7/1976 | U.S.S.R. . |
| 1063949A | 12/1983 | U.S.S.R. . |
| 1084389A | 4/1984 | U.S.S.R. . |
| 1476082A | 4/1989 | U.S.S.R. . |
| 1587149A | 8/1990 | U.S.S.R. . |

OTHER PUBLICATIONS

Product brochure entitled "Hitachi Computing Monitor HCM–1," published by Hitachi Construction Machinery Company in the United States during or about 1986.

Product brochure entitled "Off to New Frontiers of Performance," published by O & K Baumaschinen und Gwinnungstechnik in the United States, publication date unknown.

Product brochure entitled "Automatic Excavation Depth Measuring Device, " published by Komatsu Ltd. in the United States, publication date unknown.

*Primary Examiner*—Ellis B. Ramirez
*Assistant Examiner*—Edward Pipala
*Attorney, Agent, or Firm*—Van Dyke, Gardner, Linn & Burkhart, LLP

[57] ABSTRACT

A method and apparatus for controlling a trencher having a tractor that is propelled along terrain and a trenching implement adjustably mounted to the tractor at a rearward portion thereof with respect to movement of the tractor along the terrain includes monitoring movement of the tractor as it is propelled along terrain in order to survey the contour of the terrain and adjusting the position of the trenching implement with respect to the tractor as a function of the contour of the terrain in the vicinity of the trencher.

33 Claims, 11 Drawing Sheets

AUTOMATIC DEPTH CONTROL FOR TRENCHER

BACKGROUND OF THE INVENTION

This invention relates generally to construction implements and, more particularly, to trenchers which include a tractor that is propelled along terrain and a trenching implement adjustably mounted to the tractor. More particularly, the invention relates to a method and apparatus for controlling the trenching implement in order to trench to a target depth.

Underground utilities, such as gas lines, power lines, and communication cables, including coaxial cables and fiber-optic cables, are laid using a trencher that includes a tractor, which traverses the terrain on wheels or treads, and a trenching implement. The trenching implement is adjustably positioned at the rear of the tractor in the direction of movement of the tractor and is typically positioned with respect to the tractor by manual hydraulic controls manipulated by the operator. The operator is instructed to trench to a target depth, for example, 2 feet, or 26 inches or 32 inches, or whatever is desired, and to maintain the target depth irrespective of the terrain. Such trencher may additionally include a cable-feeding device, which feeds cable into the trench immediately behind the trenching implement and a pair of wings which pull the dirt, or spoil, back over the cable.

When the trencher tractor changes from a relatively planar terrain to one which slopes upwardly there is a tendency for the trenching implement to dig to a depth greater than the target depth. Likewise, when the trencher rounds the top of a hill, there is a tendency for the trenching implements to trench to a depth less than the target depth and may even come completely out of the ground. While experienced operators compensate for the non-level terrain, the operator is often distracted by other duties, such as guiding the tractor around telephone poles, fire hydrants, and other impediments. Therefore, it is not uncommon for the trenching implement to come completely out of the ground and to leave a portion of ground that is not trenched. Because the trencher may be concurrently laying underground cable, it is not possible for the operator to merely reverse the direction of the trencher and to retrench the same ground. Instead, the operator must stop the trencher and trench the missed terrain by hand. In addition to being difficult to operate, such trencher often produces unsatisfactory results with the actual depth of the trench varying from the target depth by great amounts. This makes locating of the underground cable difficult at a later date because the cable will not be at the depth location specified on the site map. Also, cables, such as fiber-optic cables, may be compromised if the trench takes an abrupt change of vertical direction, which would tend to put a kink in the cable. The operator must be exceptionally skillful to operate a manual trencher on uneven terrain without applying a kink to the cable.

Automatic controls have been proposed in order to maintain the actual depth of the trenching implement close to a target depth. However, such proposed automatic controls typically utilize a sensing device mounted to the trenching implement in order to sense a reference datum. A problem with such prior controls is that the sensor is exposed to the trenching operation and is vulnerable to soiling, damage, and even destruction. Furthermore, the use of a fixed reference datum limits the usefulness of such prior controls to relatively flat terrain which does not have large variations in elevation. Furthermore, the trencher is not capable of trenching to a constant depth perpendicular to the surface of the terrain.

SUMMARY OF THE INVENTION

The present invention provides a method and apparatus for controlling a trencher having a tractor that is propelled along terrain and a trenching implement adjustably mounted to the tractor at a rearward portion of the tractor with respect to movement of the tractor along terrain. Movement of the tractor, as the tractor is propelled along terrain, is monitored in order to survey the contour of the terrain. The position of the trenching implement is adjusted with respect to the tractor as a function of the contour of the terrain in the vicinity of the trencher.

By mapping the contour of the terrain utilizing monitors on the tractor, the slope of the terrain in the vicinity of the trenching implement, which is stored in electronic memory as a contour map, is precisely known. Thereby, the desired position of the trenching implement with respect to the tractor may be calculated utilizing the geometry of the trencher and the data points stored in the contour map. The control may thus adjust the position of the trenching implement to the desired position in order to trench to the target depth.

The present invention eliminates the necessity for placing delicate sensing instruments on the trenching implement and, thereby, avoids fouling, damage, and destruction to such instruments. Importantly, the present invention accommodates severely uneven terrain and trenches to a consistent target depth even at abrupt changes in the slope of the terrain, such as occurs when flat terrain abruptly changes to an upward slope, when a downward slope flattens out, or when rounding the crest of a hill. Furthermore, the invention may be applied to trenchers utilizing all known forms of trenching techniques.

These and other objects, advantages, and features of this invention will become apparent upon review of the following specification in conjunction with the drawings.

DESCRIPTION OF THE PREFERRED EMBODIMENT

Figure 1:
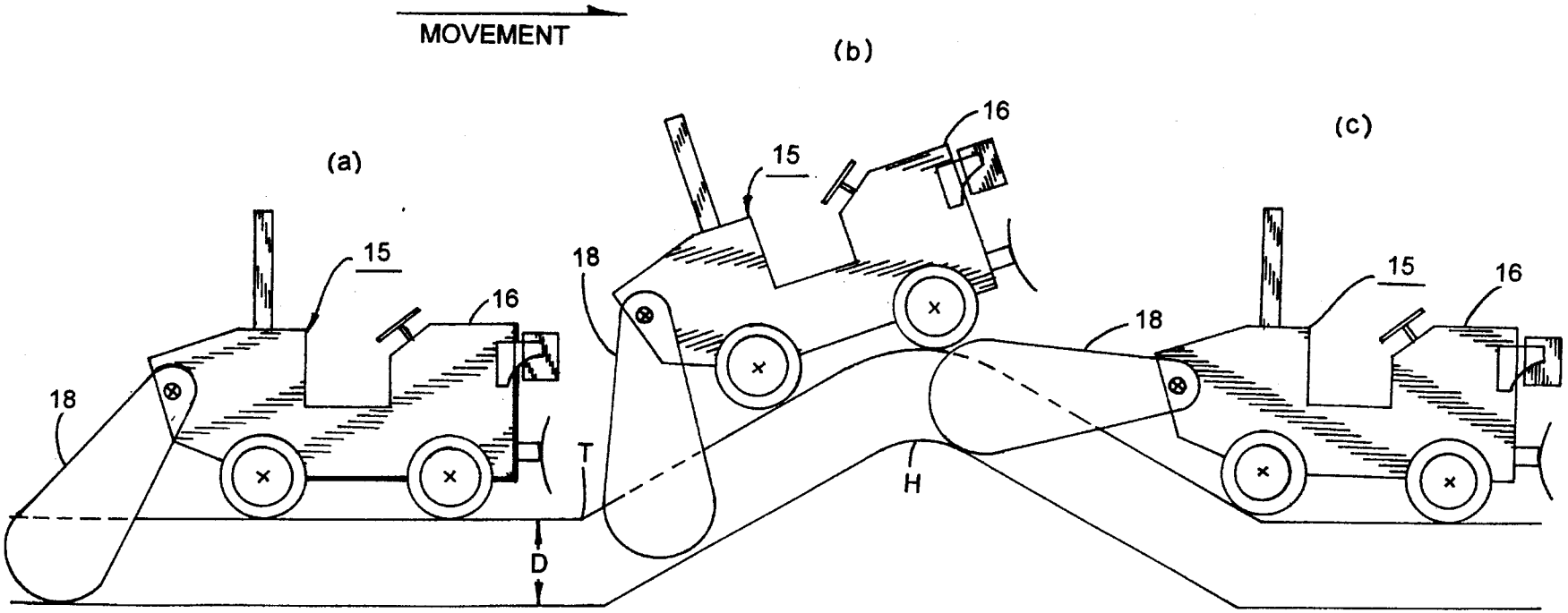
FIG. 1 is a side elevation illustrating a trencher in three different positions on a typical uneven terrain.

Referring now specifically to the drawings, and the illustrative embodiments depicted therein, unless specified otherwise, references to "up," "down," and "Y coordinates" are with respect to earth true vertical, i.e., the direction in which gravity operates. "Left," "right," and "X coordinates" refer to true earth horizontal, or the direction perpendicular to the direction in which gravity operates. "S coordinates" refers to movement along the surface of terrain being trenched. Referring now to FIG. 1, a trencher 15 having a tractor 16 and a trenching implement 18 is illustrated trenching terrain T to a target depth D. In the illustrated embodiment, a chain line trencher, having a tractor supported by four rotating wheels, is illustrated. However, the invention finds applicability to rock saw trenchers, bucket line trenchers and wheel trenchers as well as to trenchers having tractors that are propelled by tank-treads and other propulsion means. A comparison of the positions (a) and (c) of the trencher in FIG. 1 illustrate that the relative position of the trenching implement 18 with respect to the tractor 16 is significantly different as a result of the trencher traversed a hill H even though the trencher has the same orientation with respect to earth's gravity in positions (a) and (c). Also, by comparing positions (a) and (b), it can be seen that as the tractor changes from the relatively flat terrain, illustrated in position (a), to the upward slope, illustrated in position (b), the trenching implement must change to a substantially vertical orientation in order to maintain a constant target depth D. Therefore, in order to trench to a constant depth, it is insufficient to only be aware of the present orientation of the tractor and/or trenching implement.

Figure 2:
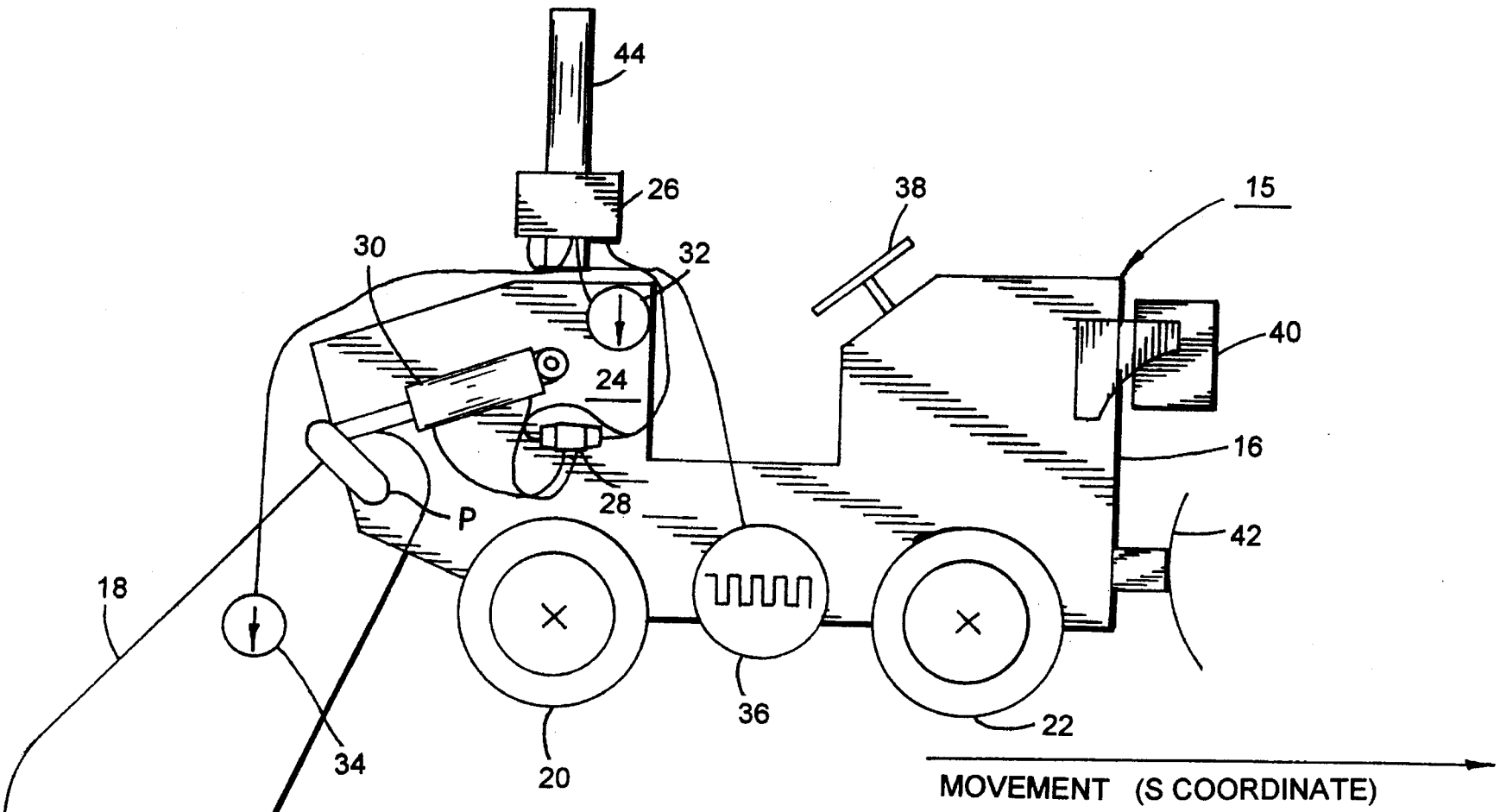
FIG. 2 is a side elevation of a trencher, according to the invention.
Figure 3:
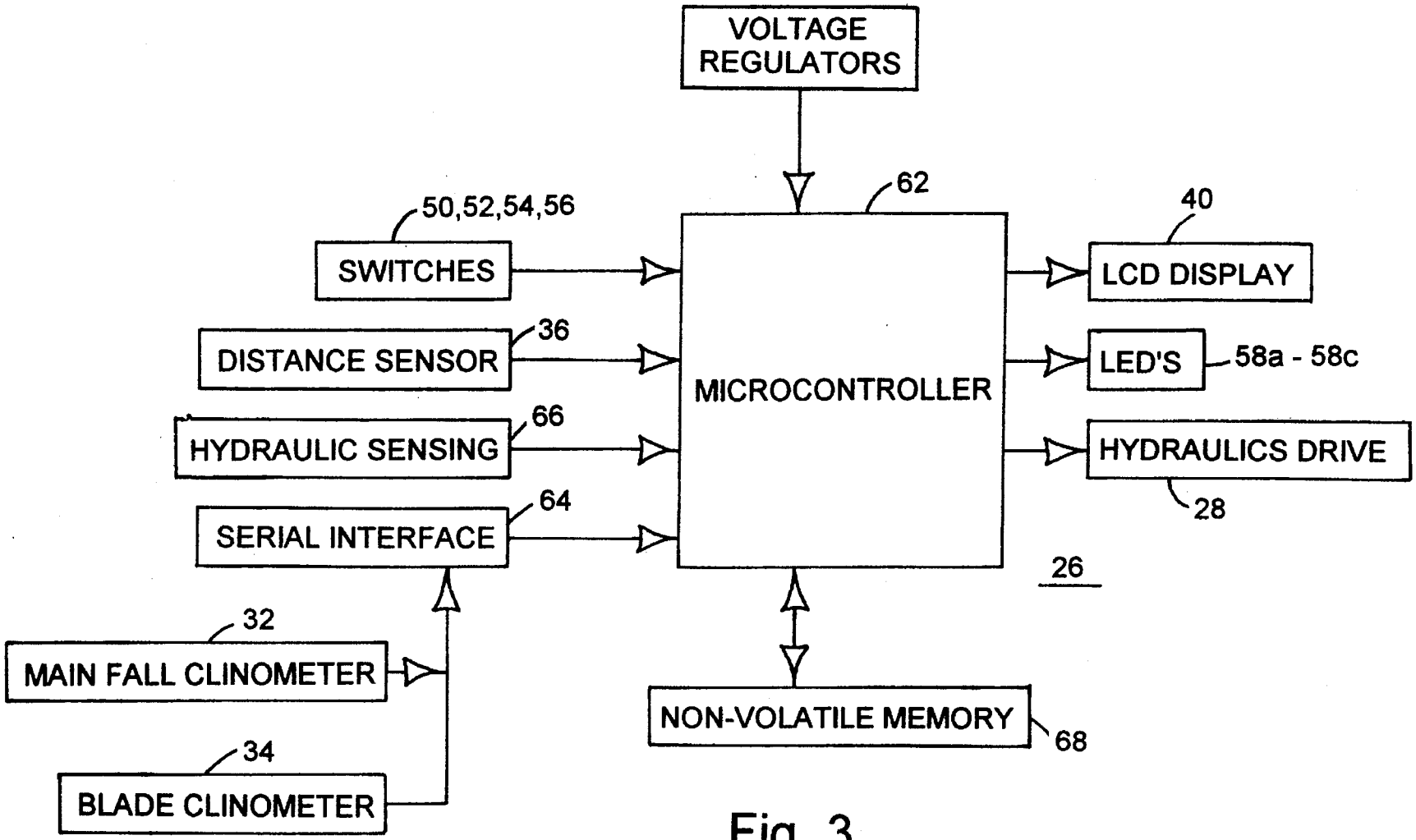
FIG. 3 is a block diagram of an electronic control system, according to the invention.

In the illustrated embodiment, trenching implement 18 is a cutter bar which is pivotally mounted at P to a rearward portion 20 of tractor 16, with respect to the direction of motion of the tractor in the S direction, as illustrated in FIG. 2. Tractor 16 additionally includes a forward portion 22. For the purposes of further discussion, the forward and rearward portions of the tractor correspond, respectively, to the point of contact between the forward and rearward wheels of the tractor and the terrain. Trencher 15 has a control system 24 which includes an electronic control circuit 26 and a hydraulic valve 28 for selectively applying hydraulic fluid to a cylinder 30 in order to position cutter bar 18. Control system 24 additionally includes three input devices, including an inclination sensor, or clinometer, 32 for sensing the main fall angle, designated alpha, of tractor 16 with respect to earth's gravity, an inclination sensor, or clinometer, 34 for sensing the angular orientation, designated beta, of cutter bar 18 with respect to earth's gravity, and a distance encoder 36 for monitoring movement of tractor 16 along the terrain, which is specified in S coordinates. As is conventional, tractor 16 includes a steering column 38, counterweight 40, a plow 42, for removing minor ground variations, and a roll-bar 44.

Figure 4:
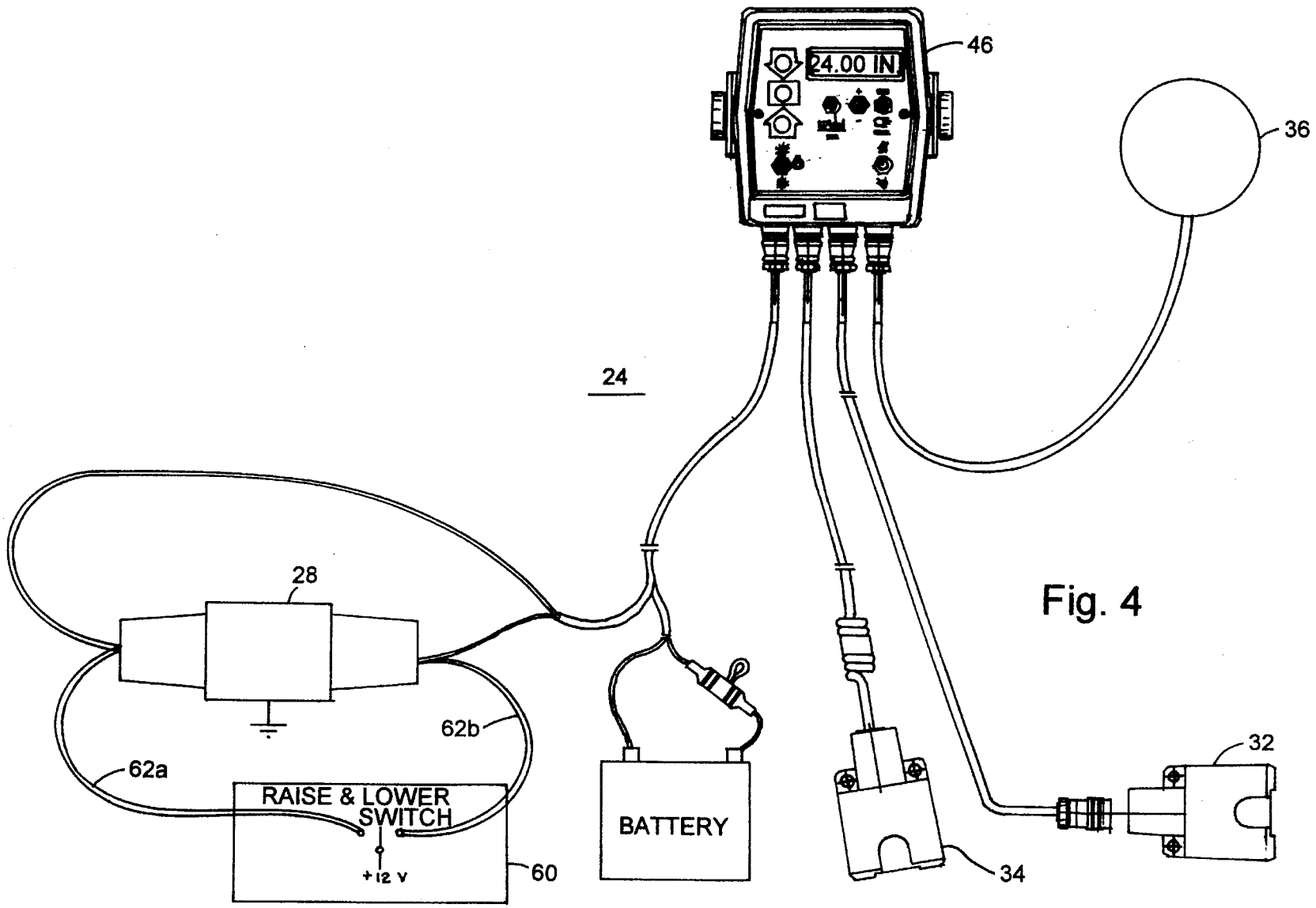
FIG. 4 is a physical diagram of the electronic control system in FIG. 3.
Figure 5:
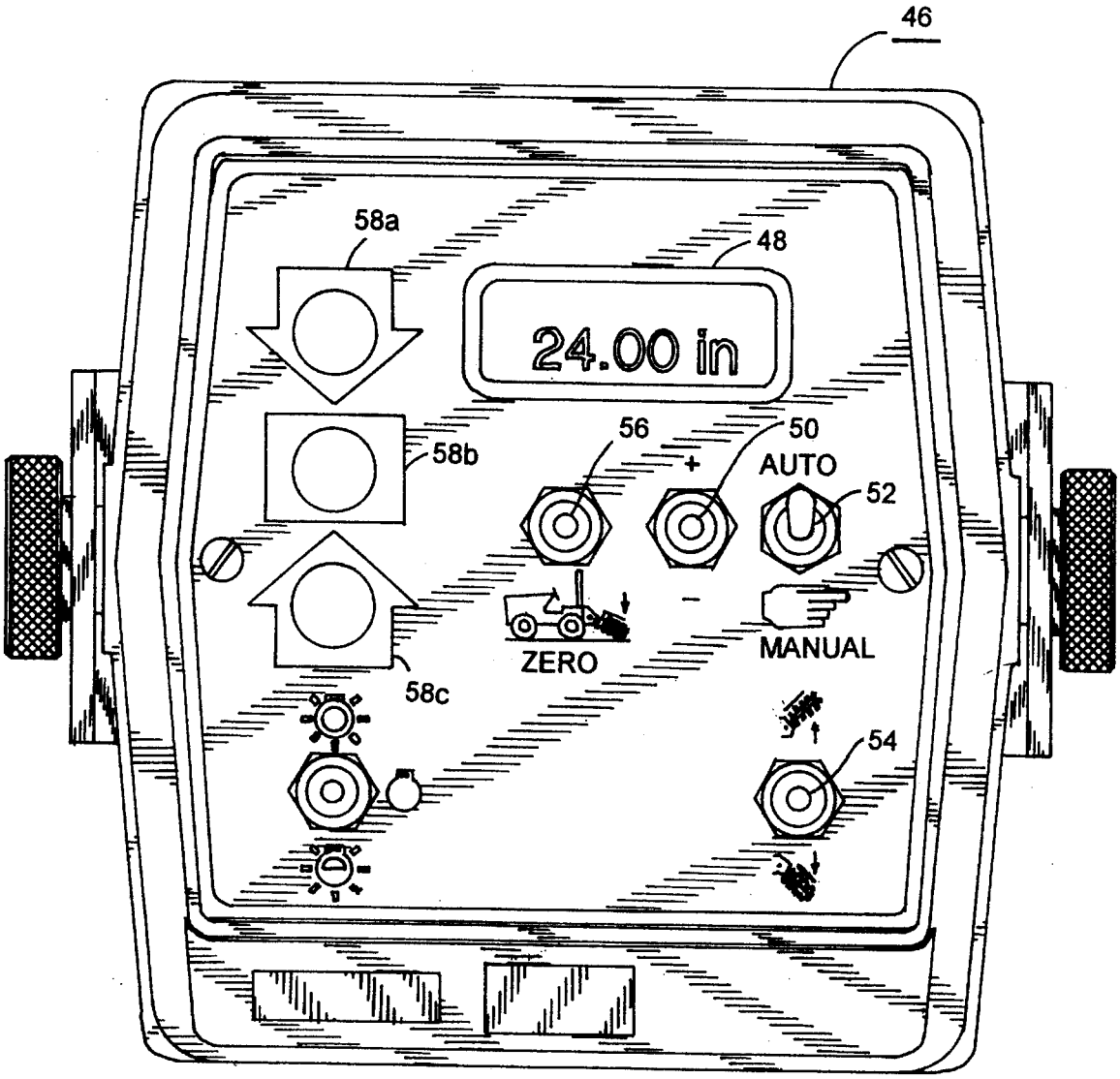
FIG. 5 is an enlarged view of the control panel in FIG. 4.

Control system 24 additionally includes a control panel 46 positioned within the convenient reach of the operator in order to receive input commands from the operator and provide visual information to the operator (FIGS. 4 and 5). Control panel 46 includes a display 48 for displaying the target depth D, which number may be set by the operator utilizing a target depth selection slew switch 50. Panel 46 additionally includes a mode switch 52, which allows the operator to place the control in either a manual mode or an automatic mode. A switch 54 allows the operator to manually raise or lower the cutter bar 18. Control panel 46 additionally includes a zero or null switch 56, which allows the operator to initialize the system, as will be set forth in more detail below. Display indicators 58*a*, 58*b*, and 58*c* indicate the position of the cutter bar with respect to the target depth D.

In the illustrated embodiment, hydraulic valve 28 is a solenoid-operated valve which has three positions to move the cutter bar either upwardly, downwardly, or to not move the cutter bar. Such solenoid valve is available from Parker Fluidpower Company under Part No. BV06S8VD012SVE6T. However, a proportional control valve may alternatively be used for hydraulic valve 28. Such proportional control valves are known in the art, such as is disclosed in U.S. Pat. No. 4,866,641 issued to Nielsen et al. for an APPARATUS AND METHOD FOR CONTROLLING A HYDRAULIC EXCAVATOR, the disclosure of which is hereby incorporated by reference. A user operable manual control 60 that is included with trencher 15 allows the operator to override the automatic operation of the control system 24 by providing contrary electrical signals over conductors 62*a*, 62*b* to hydraulic valve 28. In the illustrative embodiment, main fall sensor clinometer 32 and cutter bar clinometer 34 are commercially available electronic units which produce a digital serial signal to a microcontroller, or microcomputer; 62 over an RS-485 serial interface. Clinometer 32 is marketed by Laser Alignment, Inc., Grand Rapids, Mich., the present Assignee, under Model No. 41414-01. Cutter bar clinometer 34 monitors the orientation of the cutter bar with respect to earth vertical. Because clinometer 32 monitors the orientation of tractor 16 with respect to earth vertical, the orientation of the cutter bar with respect to the tractor is known. Distance encoder 36, in the illustrative embodiment, is a commercially available electronic encoder which is marketed by CUI Stack of Beaverton, Oreg., under Model No. ME205A0300C and is operated by a terrain-contacting contacting "fifth wheel" (not shown). The purpose of encoder 36 is in order to measure movement of the tractor 26 along the terrain in S coordinates.

In the illustrated embodiment, microcomputer 62 is an 8-bit Model UPD78P214L microprocessor available from NEC and having 256 bytes of on-board RAM and a total of 8K bytes of program memory. Electronic control 26 further includes a serial interface 64 for buffering the serial signals to and from main fall clinometer 32 and cutter bar clinometer 34 to microcomputer 62. In the illustrated embodiment, serial interface 64 is a commercially available integrated circuit marketed by Dallas Semiconductor of Dallas, Tex., under Model No. DS75196BTN or DS95196BTN. A hydraulic sensing unit 66 provides status condition to microcontroller 62 of the status of switch 60 in order to inform the microcontroller that the operator is manually overriding the automatic control. A non-volatile memory 68 stores values related to the geometry of the trencher 15, which are set during assembly of the control system 24 to the trencher 15. Non-volatile memory 68 may additionally include temporary storage of parameters related to a contour map made by the control system 24 prior to de-energization of the control system in order to allow the trencher to continue operating in its same location based upon previously obtained contour data; for example, if the operator stops for a break and resumes trenching at the same location.

As will be set forth in more detail below, as tractor 16 traverses a terrain T, a contour map of the terrain is made by the use of clinometer 32 and distance encoder 36 as input to electronic control 26. More particularly, in X, Y coordinates of true earth horizontal and vertical measurements, the Y coordinate of forward portion 22 is calculated for each increment in the X direction and stored in a contour map. This slope data at the front wheel of the tractor is obtained from the known Y coordinate of the rearward portion 20, calculated when the forward portion was at the current position of rearward portion, and previously stored in the contour map and the main fall angle, alpha, of tractor 16. In this manner, a map of the contour of the terrain is made in equal increments in the X direction with the corresponding Y coordinate being stored in memory in the form of a contour map of the terrain. With the contour map establishing the slope of the terrain at the location of the rearward portion 20 of the tractor and the cutter bar 18, the desired position of the cutter bar with respect to the tractor may be calculated and the actual position of the cutter bar compared with the desired position and servo-controlled to the desired position. In this manner, a trench may be dug at a desired depth, either measured perpendicular from the slope of the terrain or with respect to earth vertical.

Figure 6:
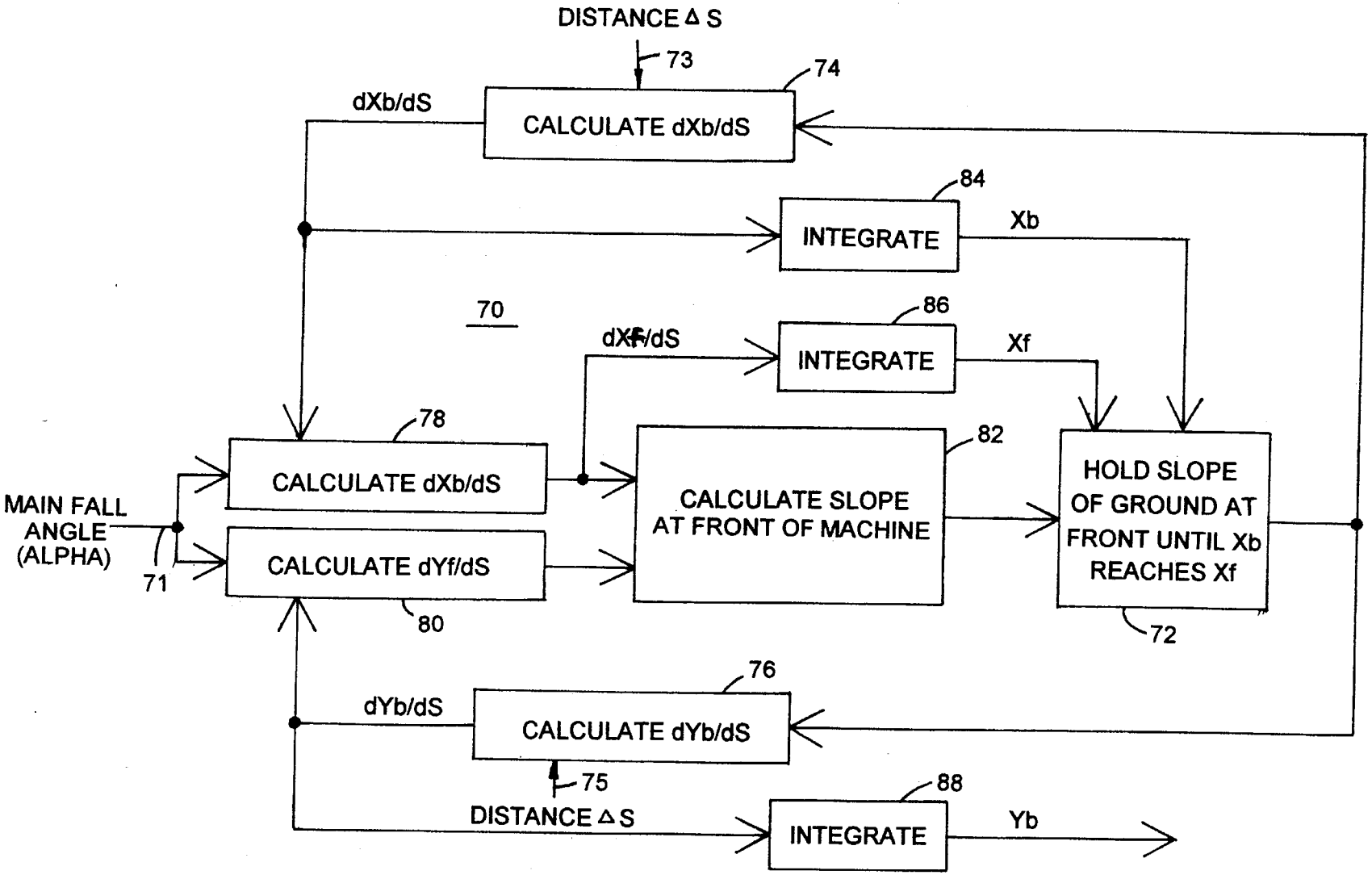
FIG. 6 is a control block diagram of the terrain surveying, or contour mapping function, according to the invention.
Figure 7:
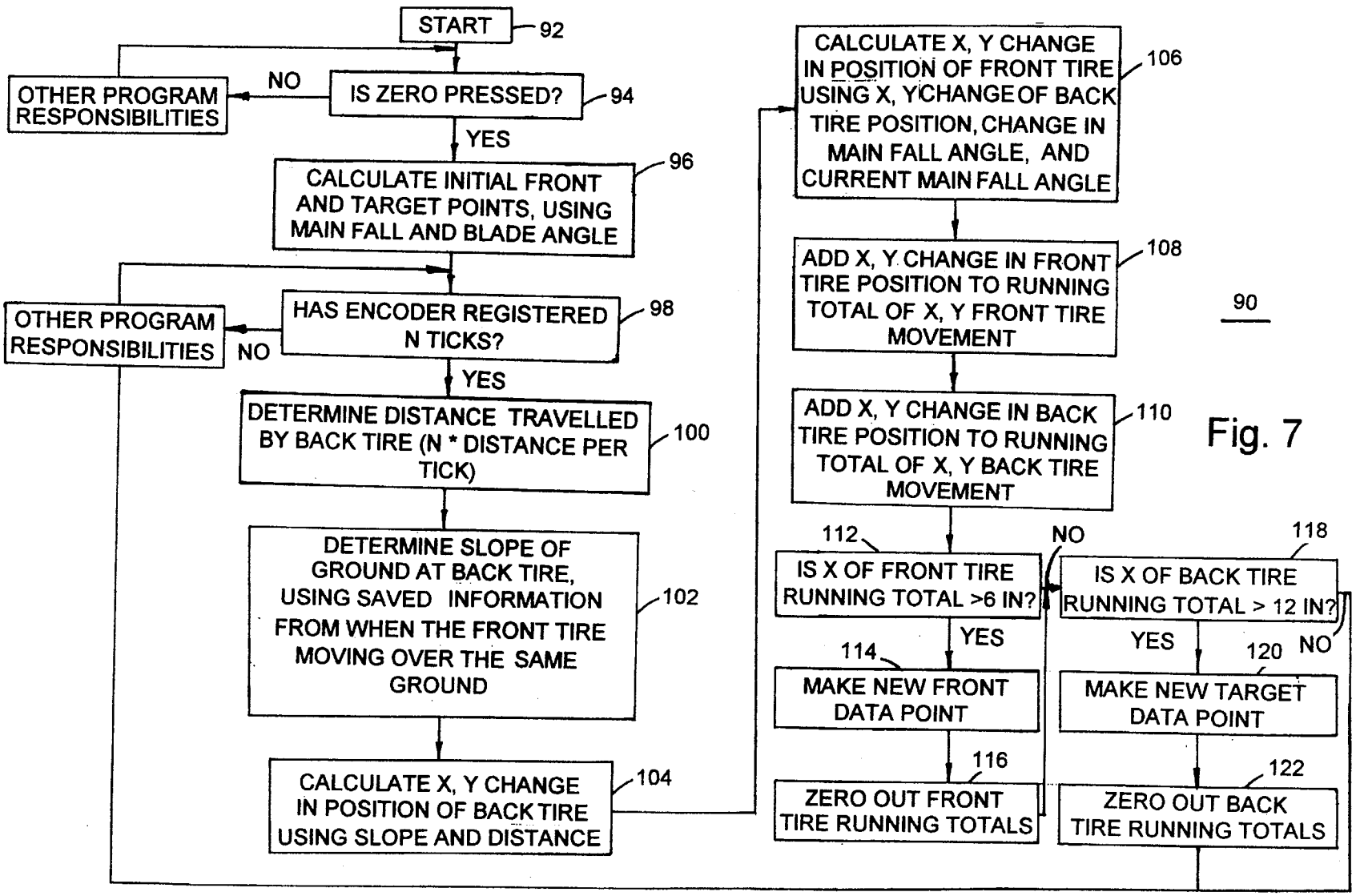
FIG. 7 is a flowchart of the terrain surveying function in FIG. 6.

More particularly, a contour mapping function 70 receives an input 71 representing the main fall angle, alpha ($\alpha$), of tractor 16 from clinometer 32 and an input (not shown) representing incremental movements of the tractor from the distance encoder 36 (FIGS. 6 and 7). The contour mapping function includes a memory step 72 in which the value of the slope of the terrain, calculated at the front portion 22 and previously saved in memory, is recalled when the back portion 20 rides over the same portion of terrain that the front tire was on when the slope values were calculated. The memory is finite and is updated at discrete intervals. The slope at the back tire is calculated at 74 and 76 in terms of the incremental change in the X, Y coordinates for each incremental change in the distance travelled along the terrain, received from clinometer 32 and provided, respectively, as inputs 73 and 75. The slope at the rearward portion 20 is expressed as:

$$M_b = dY_b/dX_b \tag{1}$$

Where $dY_b$ is the incremental change in the X coordinate at the rear tire and $dX_b$ is the incremental change in the Y coordinate at the rear tire. The total incremental movement over the terrain in terms of $dY_b$ and $dX_b$ may be expressed as:

$$dS = \text{sqrt}(dX_b^2 + dY_b^2) \tag{2}$$

By combining equations 1 and 2, the rate of change of the surface of the ground at the back tire in X, Y coordinates is determined to be:

$$dY_b/dS = M_b/\text{sqrt}(1+M_b^2) \tag{3}$$

$$dX_b/dS = 1/\text{sqrt}(1+M_b^2) \tag{4}$$

Using the rate of change of the surface of the ground at the back tire in the X, Y directions as a feedback signal, these parameters are combined at 78, 80 with the main fall angle alpha in order to calculate the rate of change of the slope at the front tires.

The vehicle's geometry at any given time can be characterized by two equations:

$$X_f = X_b + L\cos\alpha \tag{5}$$

$$Y_f = Y_b + L\sin\alpha \tag{6}$$

Where $\alpha$ is the main fall angle of tractor 16. These equations are differentiated with respect to S, the distance travelled by the back tire over the surface of the terrain:

$$dX_f/dS = dX_b/dS - L\sin\alpha\, d\alpha/dS \tag{7}$$

$$dX_f/dS = DY_b/dS + L\cos\alpha\, d\alpha/dS \tag{8}$$

The new data for the rate of change of the surface of the ground at the front portion of the machine is converted to slope data at 82 by taking the quotient $(dY_f/dS)/(dX_f/dS)$. This slope data is saved, along with the X coordinate of where the front tire is ($X_f$). When the back tire's X coordinate ($X_b$) reaches this value, the value of ground slope corresponding to this X coordinate will be retrieved from memory at 72. The rate of change signals are integrated at 84, 86, and 88 in order to obtain values of $X_b$, $X_f$, and $Y_b$. The values of $X_b$ and $Y_b$ are periodically saved, forming an X, Y contour map of the ground at the rearward portion of the vehicle.

The contour mapping function 70 may be further understood by reference to flowchart 90 of the same function. Operation of the function is initiated at 92 by the vehicle operator placing the tractor 16 on a terrain that is reasonably flat and level. Although it is not required for the operation of the control function to have the tractor on level surface, the clinometers are more accurate the closer they are to gravitational level. Also, the flatter the ground, the sooner the control function converges to an optimal solution. The operator also places the tip of the cutter bar on the ground and presses zero button 56 at 94. An initial calculation is made at 96 of the X, Y coordinates of the forward portion 22 and a target point of the cutter bar are made at 96 utilizing main fall angle alpha and blade angle beta. As the operator causes tractor 16 to traverse the terrain, the controller monitors distance encoder 36 and determines at 98 when a given number of encoder ticks have occurred. The distance ticks are in the S coordinate. After N ticks have occurred, the control determines at 100 the distance travelled in the S direction and determines the slope of the ground at the back tire at 102 using data points entered into the contour map when the forward portion 22 was moving over the same portion of terrain. In order to reduce feedback oscillations in the control algorithm, three slope determinations are made at 102 and averaged. The three determinations are made at the portion of the terrain immediately before and after the rearward wheel as well as at the rearward wheel. The change in the X and Y coordinates of the rearward portion 20 are calculated at 104 using the slope and distance information determined at 100 and 102. The change in the X, Y coordinates of the position of the forward portion 22 are calculated at 106 using the change in the X, Y coordinates of the rearward portion 20 and the main fall angle alpha as well as the rate of change of the main fall angle alpha. The change in the X, Y coordinates of the forward portion 22 are added to the present coordinates at 108 and the X, Y coordinates in the rearward portion 20 are updated at 110.

It is then determined at 112 whether the forward portion 22 has moved a total fixed distance, which in the illustrated embodiment is six inches, since the last data entry was made in the contour map. If so, a new data point is entered at 114 and the counter is zeroed at 116 in order to begin the next fixed-distance interval. The position of the rearward portion 20 is evaluated at 118 in order to determine if it has travelled a fixed distance, which in the illustrated embodiment is 12 inches. If so, a new target depth data point is calculated at 120 and the counter is zeroed at 122. Although data points for the contour map are entered in fixed increments and new target data points are established at fixed increments that are both relatively large, the control routines operate in between data points utilizing extrapolation routines as would be readily apparent to those skilled in the art.

Figure 8:
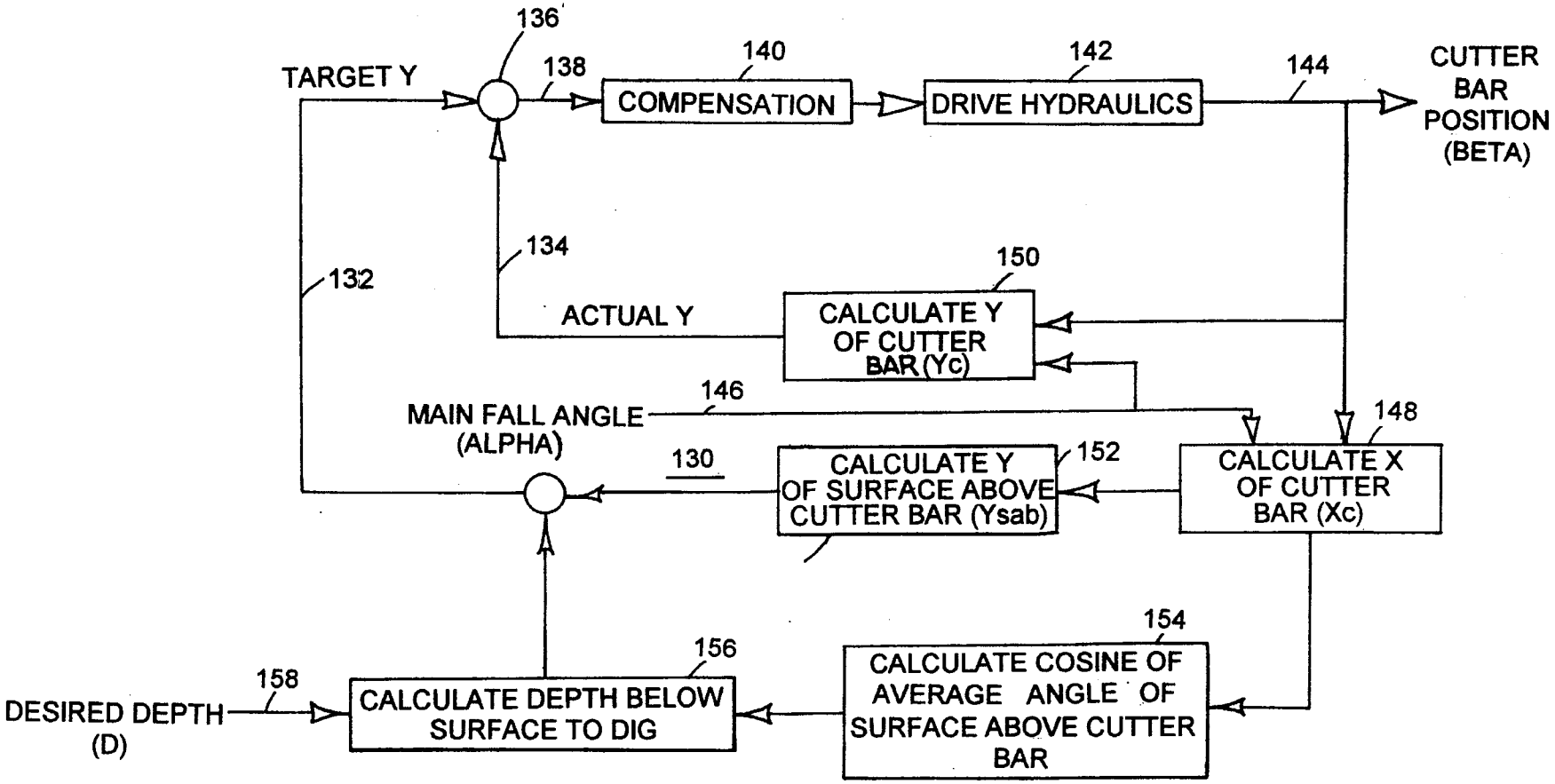
FIG. 8 is a control block diagram of the trenching implement positioning function, according to the invention.
Figure 10:
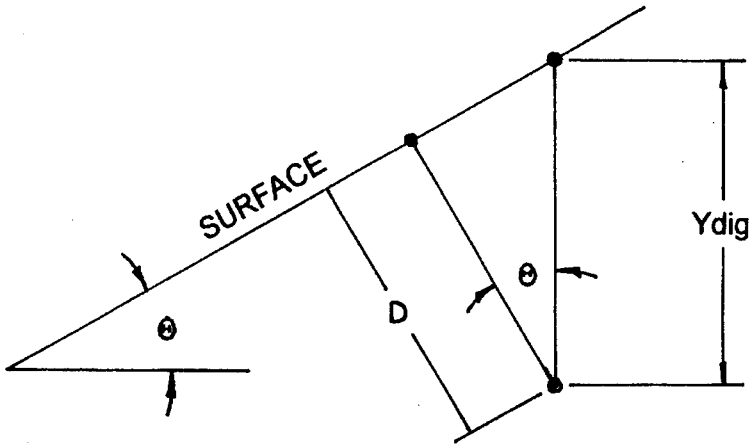
FIG. 10 is a diagram illustrating the geometric relationships of particular parameters utilized in the control function of FIG. 8.
Figure 9:
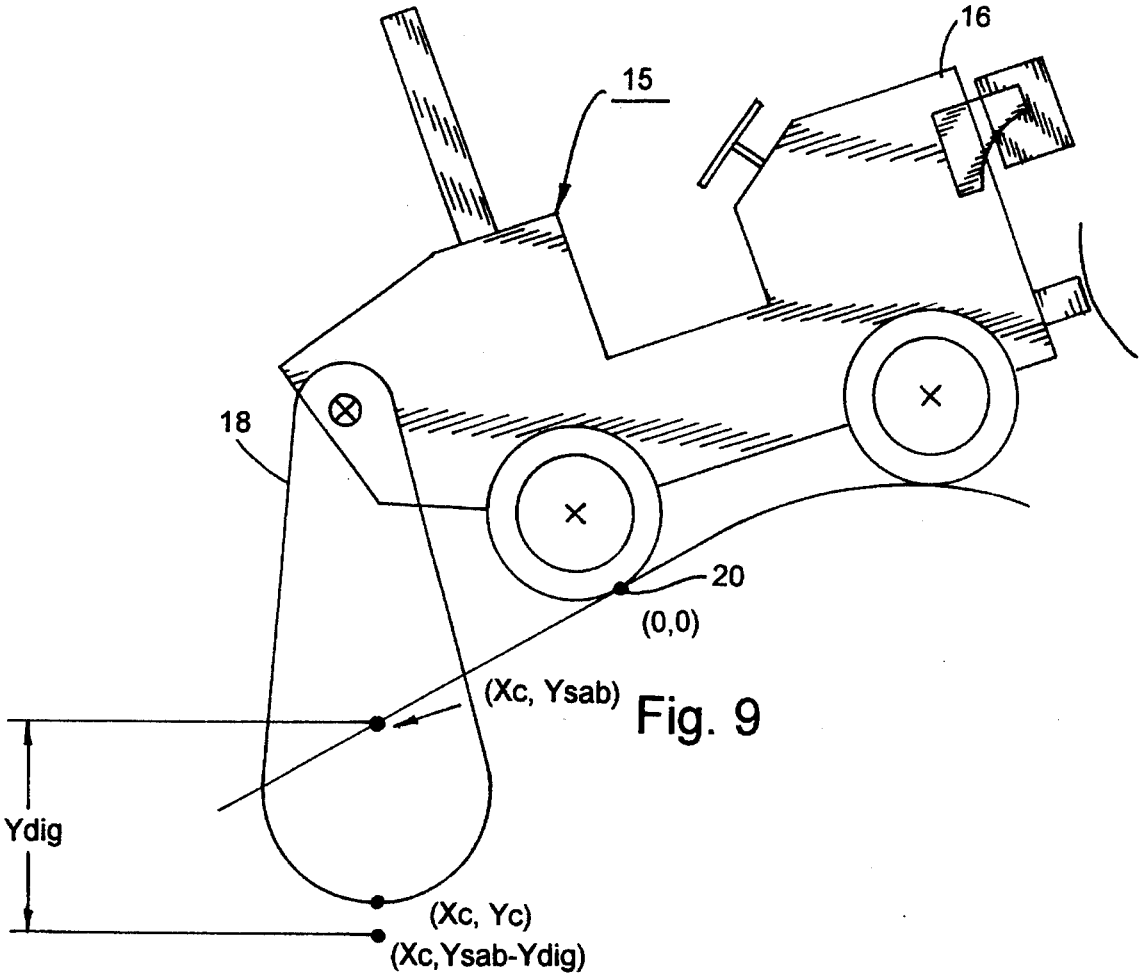
FIG. 9 is a diagram illustrating the geometric coordinates used in the control function in FIG. 8.

As the terrain in the vicinity of the trencher 15 is surveyed and entered in the contour map, the position of the cutter bar may be controlled as a function of the contour of the terrain, the geometry of the trencher, cutter bar angle beta, and tractor main fall angle alpha using a cutter bar control function 130 (FIGS. 8–10). The position of the cutter bar is monitored at 144 by clinometer 34, which value is combined with the main fall angle alpha, as monitored at 146 by clinometer 32 in order to calculate at 148 an X coordinate of the cutter bar tip ($X_c$) relative to rearward portion 20 utilizing the geometry of trencher 15 as well as the angle readings alpha and beta of the two clinometers 34 and 32. The Y coordinate of the tip of the cutter bar ($Y_c$), relative to rearward portion 20, is calculated at 150 utilizing the geometry of the trencher, as well as the alpha and beta angle readings of the two clinometers 34 and 32. The Y coordinate of the terrain surface above the blade tip, relative to rearward portion 20 ($Y_{sab}$), is calculated at 152 by interpolating a Y coordinate from the contour map at the location which corresponds to the X coordinate of the cutting bar tip ($X_c$), which was calculated at 148. The cosine of the angle theta ($\Theta$), which is the average slope of the terrain above the cutter bar tip, is calculated utilizing geometry. The slope, which is equal to the tangent of the angle theta, is obtained from the contour map and is converted from tangent theta to cosine theta utilizing a look-up table. The target vertical depth ($Y_{dig}$) is calculated at 156 by comparing the cosine value obtained at 154 with a desired depth D entered by the operator at 158 utilizing switch 50. The target vertical depth ($Y_{dig}$) is compared with the Y coordinate of the terrain above the cutter bar tip ($Y_{sab}$) at 160 in order to determine a target Y coordinate for the cutter bar. The target position (132) of the cutter bar tip in the Y coordinate (132) is compared at 136 with an actual Y coordinate (134) in order to arrive at an error value (138).

Various forms of error signal compensation may be carried out at 140 including clipping the error signal to zero when the error signal is within a specified null band, inside of which no position adjustment is to be performed, as well as providing any proportional, integral, and derivative (PID) compensation to the error signal, as is known in the art. The error signal is presented to the drive hydraulics at 142 wherein adjustments are made for the response of the hydraulic valve 28, including the nature of the hydraulic valve used. The signal is applied to the valve 28 which modulates hydraulic fluid to cylinder 30, which results in a change in the position of the cutter bar at 144.

Although, in the illustrative embodiment, the target and actual positions of the cutter bar are measured from the perpendicular of the slope of the terrain surface at the point of trenching, it is possible to trench to a target depth that is measured in a vertical dimension. However, by measuring perpendicular to the surface, a more consistent trench depth is obtained. It would also be possible to provide in the control functions a minimum angle change in the floor of the trench in order to avoid any abrupt changes which may create kinks in fiber-optic cables, or the like. It would also be possible to provide in the control function a routine that filters out any minor variations in the terrain surface, such as small bumps and the like. It would additionally be possible to take into account the relative weight distribution of the tractor on the respective front and rear wheels in order to compensate for any possible variations in actual positions of the wheels as a result of burrowing of the wheels in the ground.

The present invention provides an exceptionally rugged and easy-to-use control for a trencher which accommodates great variation in terrain while maintaining a consistent trench depth. This is accomplished by surveying the contour of the terrain traversed by the tractor of the trencher and producing a contour map representative of the sloped terrain at incremental positions. Any error that may occur in measurement of the Y coordinate will not adversely accumulate because the contour data points are relevant only in the vicinity of the trencher. Therefore, any error that may have occurred previously will not significantly enter into the control functions.

Figure 12:
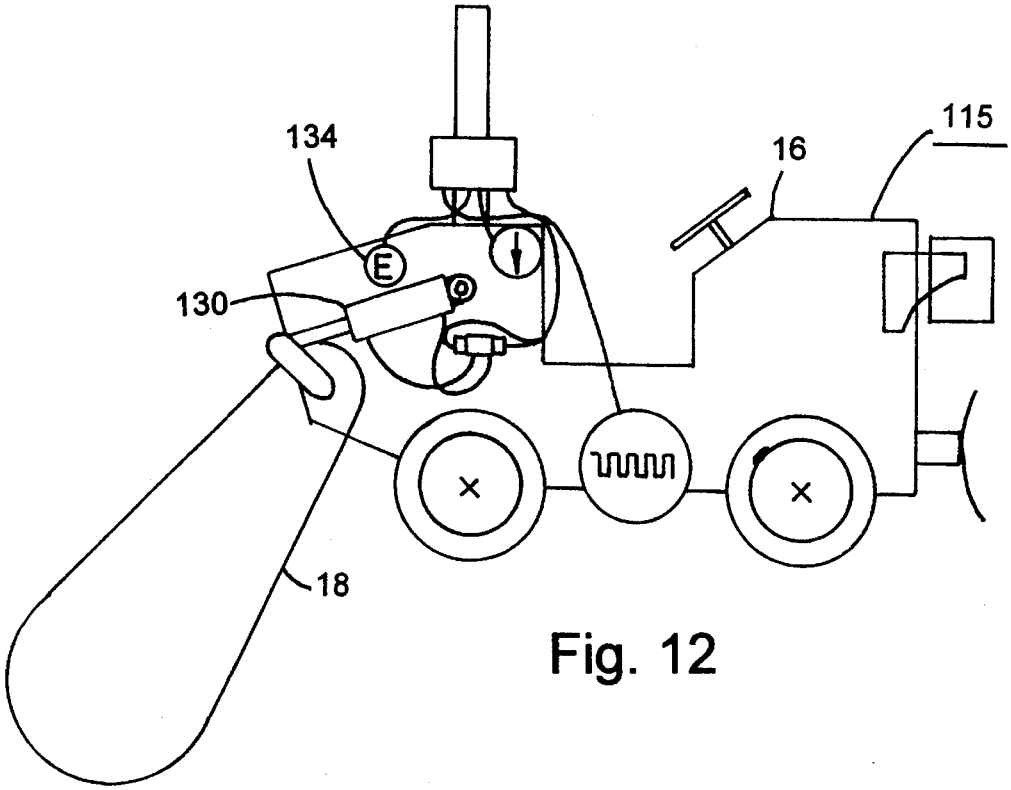
FIG. 12 is the same view as FIG. 2 of a second alternative embodiment of the invention.
Figure 11:
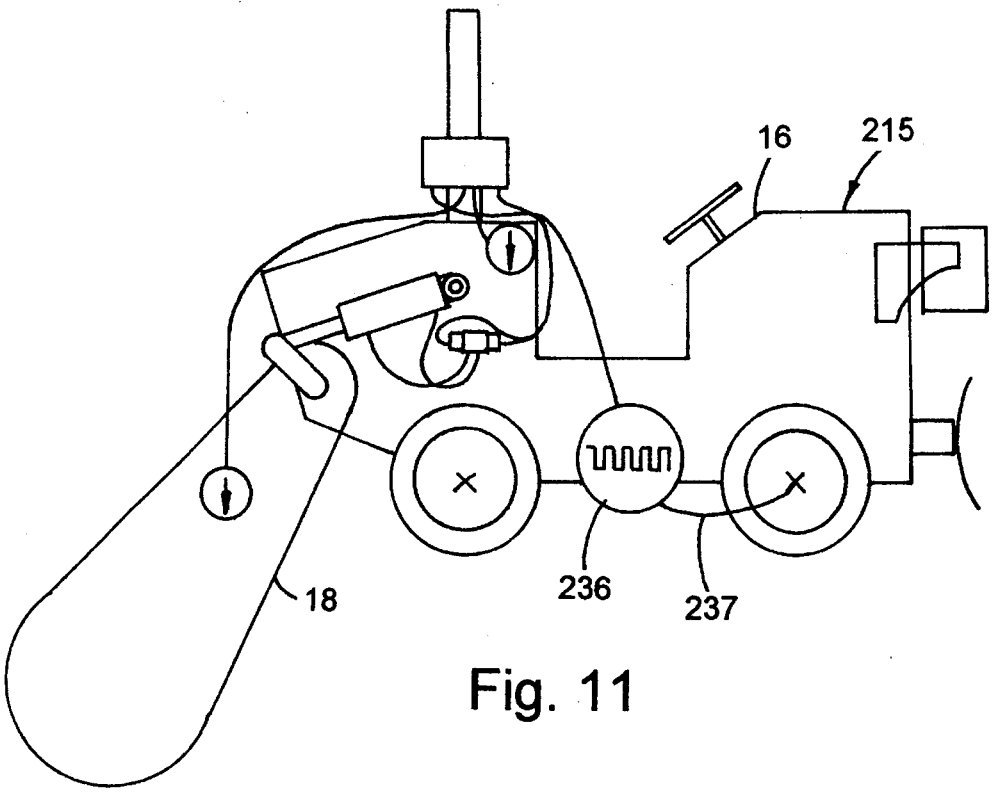
FIG. 11 is the same view as FIG. 2 of a first alternative embodiment of the invention.
Figure 14:
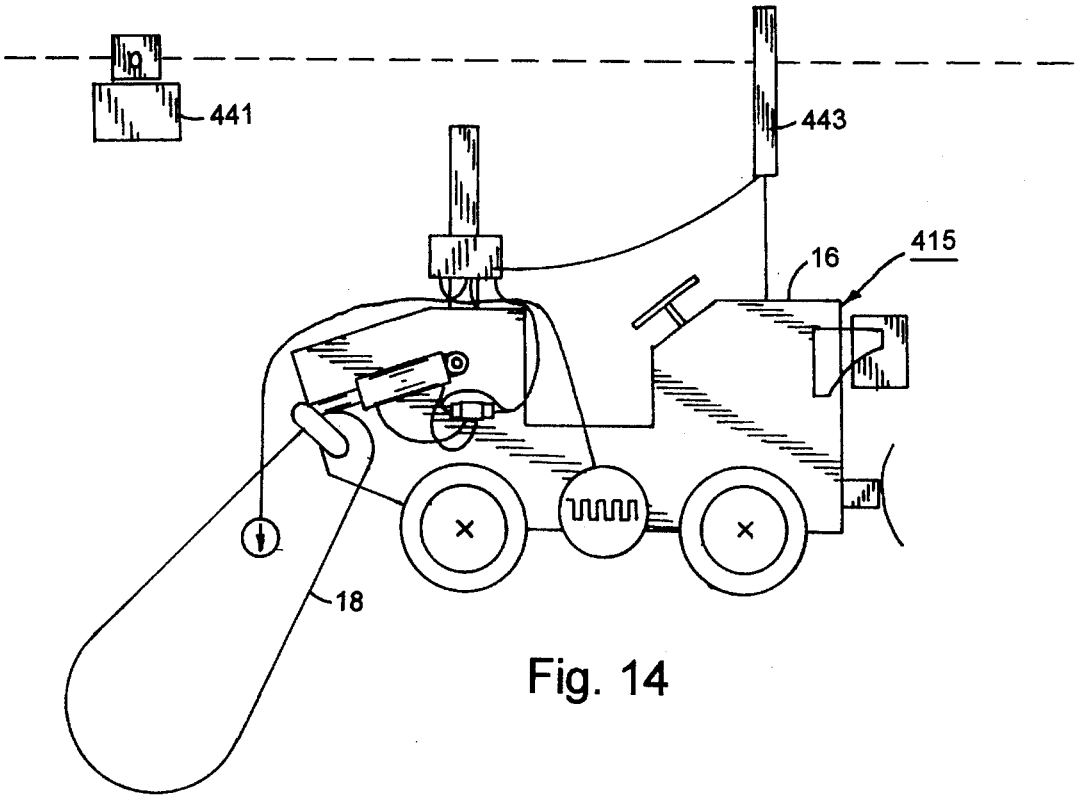
FIG. 14 is the same view as FIG. 2 of a fourth embodiment of the invention.
Figure 13:
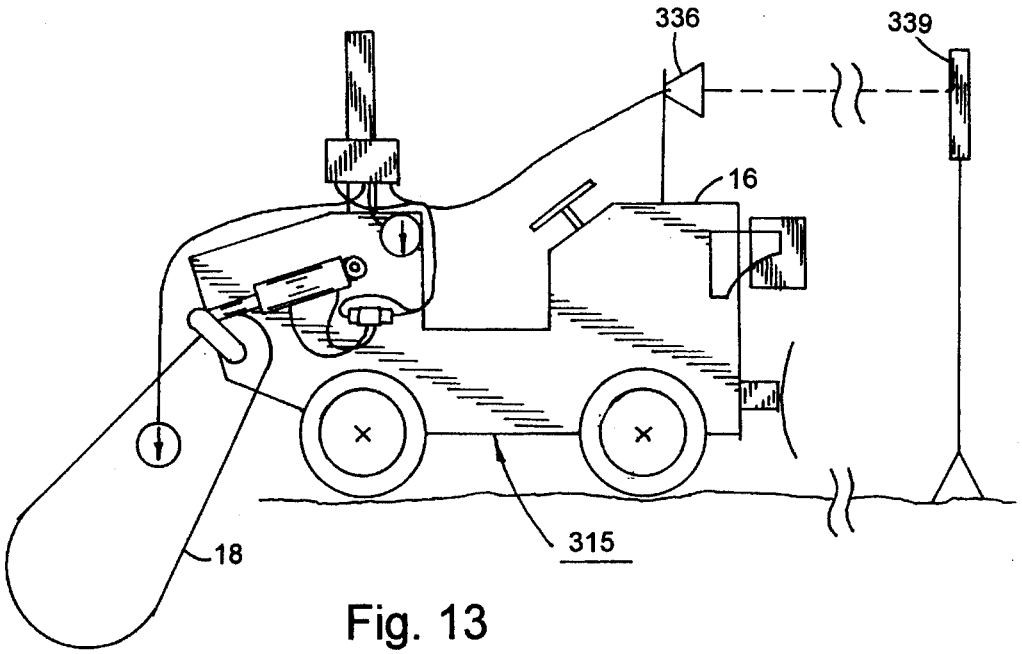
FIG. 13 is the same view as FIG. 2 of a third embodiment of the invention.

An alternative trencher 115 utilizes an encoder 134 in order to monitor the rotational position of the cutter bar with respect to the tractor (FIG. 12). One such encoder may be provided integrally with hydraulic cylinder 130 and is supplied by Parker Fluidpower Company under Model No. Parkertron CBB2HXLTS13AC60 with feedback code A-0-B-2. Other encoders for mounting directly to the rotational joint between the cutter bar and the tractor are also available. Another alternative trencher 215 utilizes a distance encoder 236 that is operated directly from rotation of one of the wheels, or tank-treads, of the tractor, as illustrated by the linkage 237 (FIG. 11). However, either slippage between the propulsion means and the terrain must be avoided or else compensated for. Other distance-monitoring techniques are also possible. For example, a trencher 315 has a transceiver 336, which may utilize infrared, ultrasonic, or microwave signals reflected off of a stationary target 339 in order to determine distance travelled by the tractor 16 (FIG. 13). Additionally, video-monitoring camera monitoring movement of the ground in order the trace the speed of the image traversing the terrain is possible. Likewise, monitoring movement of the tractor with respect to a staked string may be utilized.

Although the invention has been described with the use of a distance encoder and inclination sensor to survey the contour of the terrain, other techniques are possible. For example, a trencher 415 includes a laser plane generator 441 stationarily positioned in order to establish a fixed datum. A laser receiver 443 on the tractor could be utilized to establish the Y coordinates. Such laser receiver may be of the type disclosed in U.S. Pat. No. 4,805,086 issued to Nielsen et al. for an APPARATUS AND METHOD FOR CONTROLLING A HYDRAULIC EXCAVATOR, the disclosure of which is hereby incorporated by reference. Also, satellite ground positioning systems may be used, which may provide X, Y, Z coordinates of the tractor, and therefore the terrain, at desired increments.

Other changes and modifications in the specifically described embodiments can be carried out without departing from the principle of the invention, which is intended to be limited only by the scope of the appended claims, as interpreted according to the principles of patent law including the doctrine of equivalents.

The embodiments of the invention in which an exclusive property or privilege is claimed are defined as follows:

1. A method of controlling a trencher having a tractor that is propelled along terrain and a trenching implement adjustably mounted to said tractor at a rearward portion of said tractor with respect to movement of said tractor along terrain, including:

monitoring movement of the tractor as said tractor is propelled along terrain in order to establish in a memory a contour map of the slope of the terrain in the vicinity of the trencher; and adjusting the position of said trenching implement with respect to said tractor as a function of the slope of the terrain at the trenching implement by retrieving data from the contour map.

2. The method of claim 1 wherein said monitoring movement of said tractor includes monitoring distance travelled by the tractor along the terrain and the main fall angle of the tractor with respect to true horizontal.

3. The method of claim 2 including determining the slope of the terrain at a rearward portion of said tractor.

4. The method of claim 3 including determining the slope of the terrain at a forward portion of said tractor with respect to movement of the tractor and storing said slope at said forward portion.

5. The method of claim 4 wherein said slope at said forward portion is determined as a function of said slope at said rearward portion of said tractor and said main fall angle of said tractor.

6. The method of claim 4 wherein said slope at said rearward portion of said tractor is obtained from stored values of said slope at said forward portion.

7. The method of claim 1 wherein said adjusting the position of said trenching implement includes determining a target depth as a function of the slope of said terrain at said rearward portion of said tractor.

8. The method of claim 7 wherein said adjusting the position of said trenching implement further includes determining a target depth as a function of slope of said terrain at said trenching implement.

9. A method of controlling a trencher having a tractor that is propelled along terrain and a cutter bar that is rotatably mounted to said tractor at a rearward portion of said tractor with respect to movement of the tractor along terrain, including:

monitoring the distance travelled by the tractor and the main fall angle of the tractor with respect to true earth reference;

determining slope of the terrain at a forward portion of the tractor with respect to movement of the tractor along terrain utilizing the slope of the terrain at a rearward portion of the tractor and the main fall angle of the tractor;

storing the value of slope obtained at said forward portion of the tractor in a contour table;

retrieving stored values of slope from said contour table in order to establish a contour of the terrain at said rearward portion of the tractor;

retrieving from said contour table values of slope of the terrain at the cutter bar and determining a target position of said cutter bar as a function of slope of the terrain at said cutter bar and the main fall angle of the tractor; and monitoring the actual position of the cutter bar with respect to the tractor and adjusting the position of the cutter bar in order to reduce differences between said target and actual positions.

10. The method of claim 9 including establishing initial values of slope the terrain by positioning said tractor on terrain with said cutter bar in contact with said terrain.

11. The method of claim 9 wherein said determining said contour at said forward portion includes calculating a rate of change of contour at said rearward portion.

12. The method of claim 11 wherein said determining said contour at said forward portion includes calculating a rate of change of said main fall angle.

13. The method of claim 9 wherein said contour values are established relative to true earth vertical and horizontal coordinates.

14. The method of claim 9 wherein said monitoring the actual position of the cutter bar includes measuring the angle between said cutter bar and true earth reference.

15. The method of claim 9 wherein said monitoring the actual position of the cutter bar includes measuring the relative angle between said cutter bar and said tractor.

16. The method of claim 9 wherein said monitoring the actual position of said cutter bar includes measuring the actual position of said cutter bar perpendicular from the surface of the terrain at said cutter bar.

17. The method of claim 9 wherein said monitoring the distance travelled by the tractor includes providing a terrain contacting device on said tractor separate from any propulsion system of the tractor.

18. The method of claim 9 wherein said monitoring the distance travelled by the tractor includes monitoring motion of the propulsion system of the tractor.

19. The method of claim 9 wherein said monitoring the distance travelled by the tractor includes providing a sensor on said tractor which measures a distance between the tractor and a stationary member.

20. A control for a trencher having a tractor that is propelled along terrain and a trenching implement adjustably mounted to said tractor at a rearward portion of said tractor with respect to movement of said tractor along terrain, comprising:

a surveying system that is responsive to movement of the tractor along terrain in order to produce a contour map of slope of the terrain in the vicinity of the trencher; and a positioning system that is responsive to said surveying system for determining a target position of the trenching implement with respect to said tractor as a function of the slope of said terrain at the trenching implement by retrieving data from said contour map.

21. The control in claim 20 wherein said positioning system further includes a trenching implement position monitor that monitors the actual position of the trenching implement and an actuator responsive to the trenching implement monitor and the target position for moving said trenching implement toward the target position.

22. The control in claim 21 wherein said trenching implement position monitor includes an inclination sensor which measures the angle between the trenching implement and true earth reference.

23. The control in claim 21 wherein said trenching implement position monitor includes a position encoder for measuring the relative position between said trenching implement and said tractor.

24. The control in claim 20 wherein said surveying system includes a distance encoder for monitoring distance travelled by said tractor along terrain and an inclination sensor which monitors the main fall angle between said tractor and true earth reference.

25. The control in claim 24 wherein said surveying system determines the slope of the terrain at a forward portion of said tractor with respect to movement of the tractor and stores said slope at said forward portion in said contour map.

26. The control in claim 25 wherein said surveying system determines the slope of the terrain at said forward portion as a function of slope values in said contour map at the rearward portion of the tractor and said main fall angle.

27. The control in claim 26 wherein said surveying system determines the slope of the terrain at said forward portion as a function of the rate of change of said slope values at said rearward portion and the rate of change of said main fall angle.

28. The control in claim 24 wherein said distance encoder is a terrain contacting encoder separate from any propulsion system of the tractor.

29. The method of claim 24 wherein said position encoder is coupled with the propulsion system of the tractor.

30. The method of claim 24 wherein said position encoder is a sensor on said tractor which measures a distance between the tractor and a stationary member.

31. A control for a trencher having a tractor that is propelled along terrain and a cutting bar that is rotatably mounted to said tractor at a rearward portion of said tractor with respect to movement of the tractor along terrain, comprising:

an inclination sensor to monitor the main fall angle of the tractor;

a distance measuring device to monitor movement of the tractor in the forward direction;

an angle sensor to monitor an angle of the cutting bar; and a control which is responsive to said inclination sensor, said distance measuring device, and said angle sensor for establishing a relative angle between said tractor and said cutting bar that will extend said cutting bar a given distance below terrain notwithstanding variations in the shape of the terrain.

32. The control for a trencher as set forth in claim 31 wherein said angle sensor monitor the angle of said cutting bar with respect to said tractor.

33. The control for a trencher as set forth in claim 31 wherein said angle sensor monitors the angle of said cutting bar with respect to earth coordinates.

* * * * *